US006711763B2

(12) United States Patent
Batchelder et al.

(10) Patent No.: US 6,711,763 B2
(45) Date of Patent: Mar. 30, 2004

(54) BACKPACKER'S HAMMOCK AND GROUND BIVY

(75) Inventors: Robert F. Batchelder, Carbon, MT (US); Robert D. Hart, Carbon, MT (US)

(73) Assignee: Crazy Creek Products, Red Lodge, MT (US)

( * ) Notice: Subject to any disclaimer, the term of this patent is extended or adjusted under 35 U.S.C. 154(b) by 0 days.

(21) Appl. No.: 09/928,558

(22) Filed: Aug. 13, 2001

(65) Prior Publication Data

US 2003/0028962 A1 Feb. 13, 2003

(51) Int. Cl.[7] ..... A47F 3/24
(52) U.S. Cl. ..... 5/120; 5/121
(58) Field of Search ..... 5/120, 122, 123, 5/128, 130; 135/124, 125, 90

(56) References Cited

U.S. PATENT DOCUMENTS 803,091 A * 10/1905 Brayshaw ..... 5/121
1,401,846 A * 12/1921 Wiles ..... 5/121
4,071,917 A * 2/1978 Mojica ..... 5/121
4,125,909 A * 11/1978 Jacobson ..... 5/121
4,526,307 A * 7/1985 Parker ..... 224/154
4,686,720 A * 8/1987 Newell ..... 5/121
5,913,772 A 6/1999 Clark
D425,722 S 5/2000 Hennessy
6,185,763 B1 2/2001 Hennessy

* cited by examiner

*Primary Examiner*—Teri Pham Luu
*Assistant Examiner*—Frederick Conley
(74) *Attorney, Agent, or Firm*—Shook, Hardy & Bacon LLP

(57) ABSTRACT

An ultra lightweight hammock for suspension between two trees includes a rectangular top panel joined along at least three side and end edges to a bottom panel. An elongate opening permits access between the top and bottom panels. Tubular sleeves form each end of the hammock and receive elongate webs which extend from the ends of the tubular sleeves around an adjacent tree to be secured by an adjustable buckle attachment. An option pocket may be formed in the bottom panel to receive a sleeping pad.

13 Claims, 2 Drawing Sheets

BACKPACKER'S HAMMOCK AND GROUND BIVY

BACKGROUND OF THE INVENTION

This invention relates to an ultra lightweight hammock and ground bivy for backpackers and camping enthusiasts. More specifically, this invention relates to an ultra lightweight hammock for safe and secure suspension between a pair of supports.

Conventional hammocks possess several desirable features for the camper. They certainly provide comfortable sleeping accommodations. They also are particularly advantageous where the terrain is uneven, rocky, or inhabited by various ground dwellers such as insects and reptiles.

On the other hand, conventional hammocks include a variety of undesirable features which have limited their widespread use by camping enthusiasts. Weight and stability are key drawbacks. It has been long known to provide a horizontal, rigid cross member at either or both ends of the hammock in order to improve stability. A typical example of such feature is illustrated in U.S. Pat. No. 4,686,720 of Newell. The added bulk and weight of these stiffening members, however, renders the hammock unsuitable for camping equipment generally. Serious backpackers, being extremely conscious of bulk and weight, would not even consider construction of the type illustrated in Newell.

Reduced weight for a hammock has been achieved, but at the sacrifice of stability. Examples are found in U.S. Pat. No. 5,913,772 of Clark and U.S. Pat. No. 6,185,763 of Hennessy. Both eliminate the rigid support members of the type as required by Newell and similar constructions, but both are suspended at each end by a rope. One end of the rope is connected to the hammock itself (typically, to a metal ring) and the opposite end is tied to a tree or similar upright support. This results in a somewhat precarious construction where the hammock tends to roll, tip or twist along the axes of the rope lines at each end. The user must be extremely careful when using such a hammock, particularly when entering or exiting the construction, or risk being dumped to the ground. The Hennessy patent provides that the sides of the hammock can be staked to the ground intermediate the hammock ends for stability. This, of course, assumes that the terrain is suitable for secure staking.

In addition to the potential danger associated with the instability of rope ties on each end of a hammock, the user must possess some skill in knot tying in order to effectively secure the hammock to an adjacent tree. And lastly, this method of attachment typically scars or otherwise marks the bark of the tree from which a hammock is suspended. This is unacceptable to environmentally conscientious campers and backpackers who follow the socially responsible wilderness directive to "leave only your footprints."

The need remains in the camping and backpacking industry for an extremely lightweight hammock and ground bivy which provides both a safe and stable construction suspendible from trees in an environmentally responsible manner. The primary objective of this invention is to meet this need.

SUMMARY OF THE INVENTION

More specifically, an object of the invention is to provide an ultra lightweight hammock of durable construction which may be folded and packed in a minimal space.

Another object of the invention is to provide an ultra lightweight hammock which may be suspended in a stable condition between two adjacent trees in order to resist the tipping and rolling motion heretofore associated with conventional hammocks.

Yet another object of the invention is to provide an ultra lightweight hammock which may be safely and stably suspended between two adjacent trees without special knowledge or skill in knot tying techniques.

An additional object of the invention is to provide an ultra lightweight hammock which may be suspended between two adjacent trees without marring or otherwise damaging the tree bark.

A further object of the invention is to provide an ultra lightweight hammock of the character described which can also double as a ground bivy.

In summary, an ultra lightweight hammock for suspension between two trees includes a rectangular top panel joined along at least three side and end edges to a bottom panel. An elongate opening permits access between the top and bottom panels. Tubular sleeves form each end of the hammock and receive elongate webs which extend from the ends of the tubular sleeves around an adjacent tree to be secured by an adjustable buckle attachment. An option pocket may be formed in the bottom panel to receive a sleeping pad.

Other and further objects of the invention, together with the features of novelty appurtenant thereto, will appear in the description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
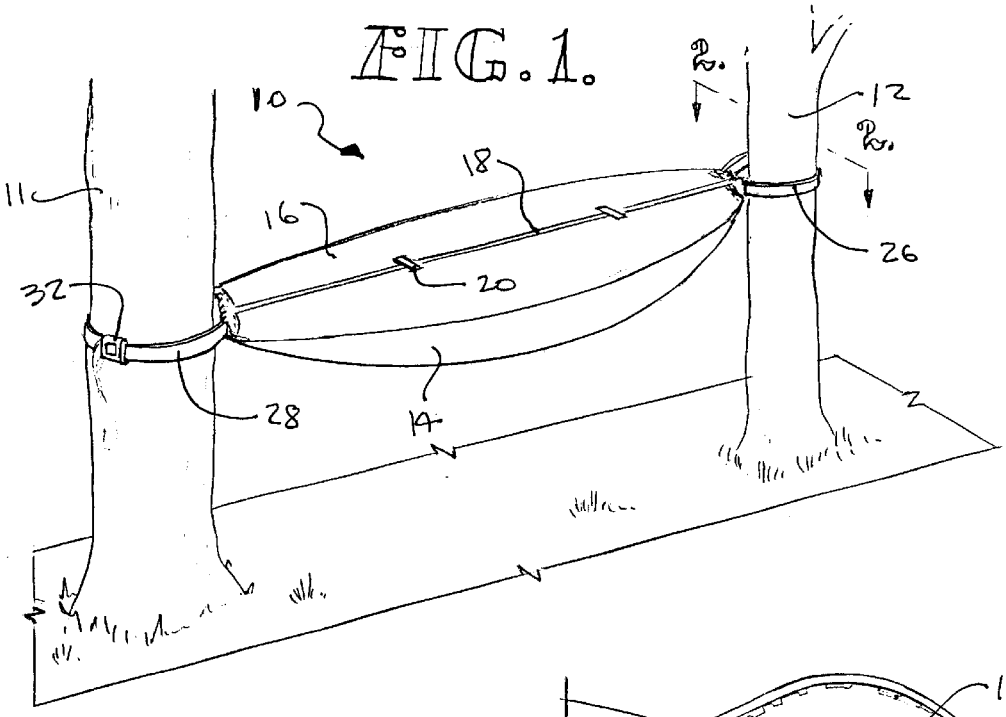
FIG. 1 is a perspective view of a hammock constructed in accordance with a first preferred embodiment of the invention shown suspending between a pair of trees.
Figure 2:
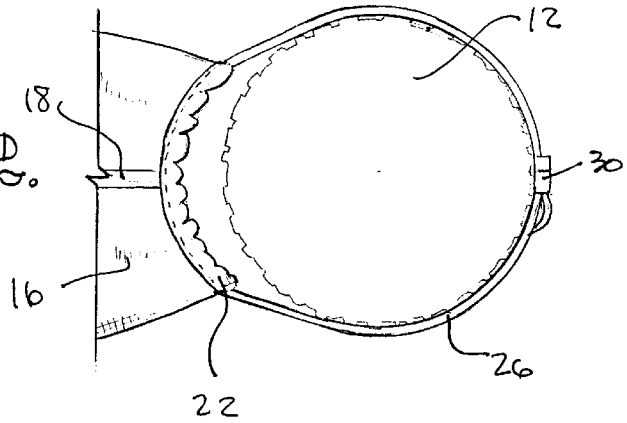
FIG. 2 is an enlarged fragmentary view of one end of the hammock taken along line 2—2 of FIG. 1 in the direction of the arrows.

Referring to the drawings in greater detail, attention is first directed to FIG. 1. which illustrates a first preferred embodiment of a hammock construction of the invention, designated generally by the numeral 10, suspended between a pair of spaced apart trees 11 & 12 or similar upright supports.

Figure 3:
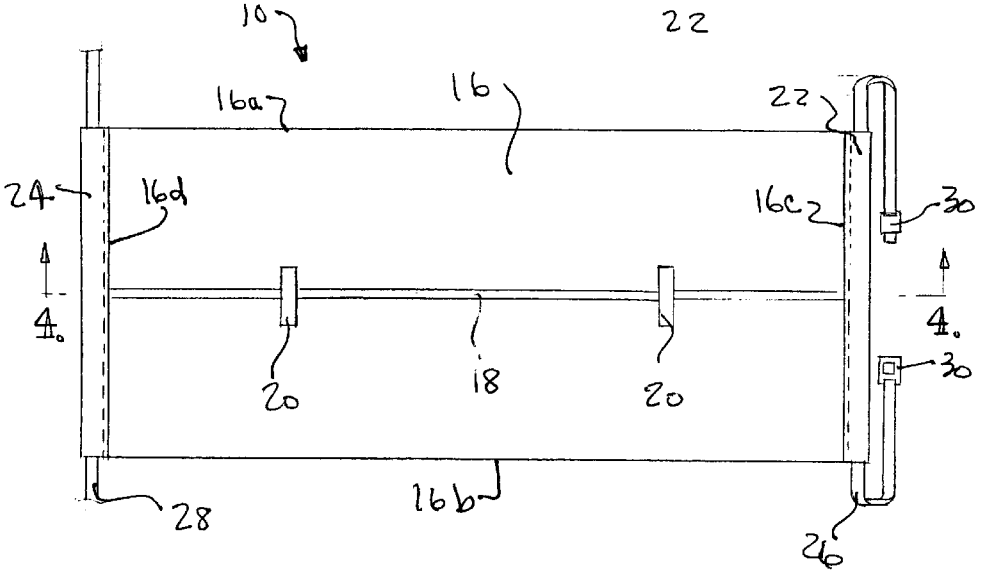
FIG. 3 is a top plan view of the hammock prior to suspension between a pair of supports.
Figure 4:
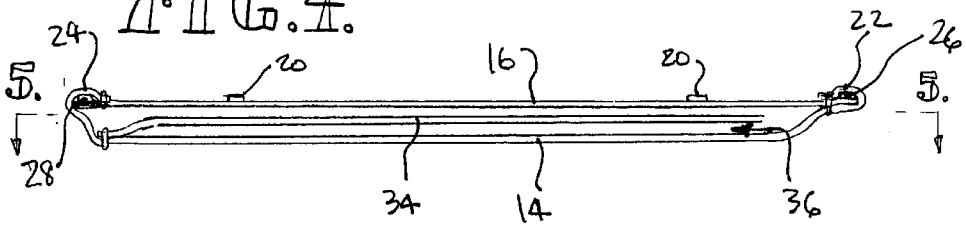
FIG. 4 is a side sectional view of the hammock taken along line 4—4 of FIG. 3 in the direction of the arrows.
Figure 5:
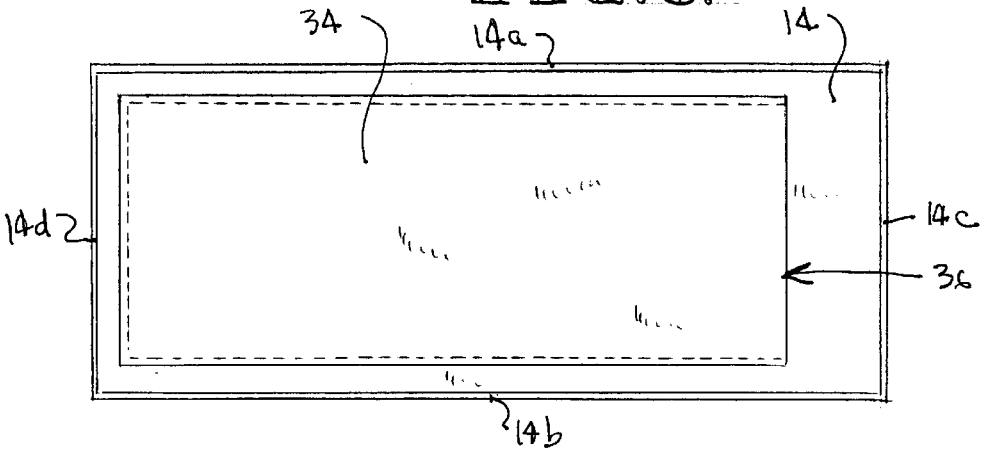
FIG. 5 is a sectional plan view of the hammock taken along line 5—5 of FIG. 4 in the direction of the arrows.

The construction of the hammock 10 can be understood with reference to FIGS. 3–5. The hammock 10 includes a generally rectangular, bottom panel 14 (FIGS. 4 & 5) having a width and a length appropriately sized to accommodate the user. The bottom panel 14 has longitudinal side edges 14*a* & 14*b* which extend along the length of the panel and lateral end edges 14*c* & 14*d* which extend along the width of the panel.

The hammock 10 also includes a generally rectangular, top panel 16 (FIGS. 3 & 4) which covers the bottom panel 14 and which has a width and a length substantially corresponding to those dimensions of the bottom panel 14. Accordingly, the top panel 16 has longitudinal side edges 16*a* & 16*b* which extend along the length of the top panel 16 and correspond respectively to the longitudinal side edges 14*a* & 14*b* of the bottom panel 14. Similarly, the top panel 16 has lateral end edges 16*c* & 16*d* which extend along the width of the top panel 16 and correspond respectively to the lateral end edges 14*c* & 14*d* of the bottom panel 14.

More particularly, in the construction of the first embodiment of hammock 10, the longitudinal side edges 14*a* & 14*b* of the bottom panel 14 are integrally formed with or securely connected to the corresponding longitudinal side edges 16*a* & 16*b* of the top panel 16. In like manner, the lateral end edges 14*c* & 14*d* of the bottom panel 14 are integrally formed with or securely connected to the corresponding lateral end edges 16*c* & 16*d* of the top panel 16.

The top panel 16 has a longitudinal slit or opening 18 intermediate the longitudinal side edges 16*a* & 16*b* thereof which may extend the substantial length of the top panel 16 to provide access to the space defined by the top panel 16 and the bottom panel 14. Fasteners 20, such as Velcro or hook and loop tabs, may be spaced along the opening 18 to selectively open or close the opening 18 as desired.

Secured at least to each end edges 14*c* & 14*d* of the bottom panel 14 are tubular sleeves 22 & 24 which extend substantially the width of the bottom panel 14. The tubular sleeves 22 & 24 may also be secured to the end edges 16*c* & 16*d* of the top panel 16.

Received respectively within the tubular sleeves 22 & 24 are web or belt members 26 & 28. Each web 26 & 28 has a width substantially greater than its thickness. Connected to the webs 26 & 28 are a corresponding adjustable buckles 30 & 32. Preferably each buckle 30 & 32 includes a takeup adjustment known to those skilled in the fastener arts such that when the buckle is closed, the tag end of the web may be pulled to effectively tighten the encircled region of the web.

As shown in FIGS. 4 & 5, an interior panel 34 is secured to the bottom panel 14 to form an interior pocket 36. Generally, the width and length dimensions of the interior panel 34 are less that the corresponding width and length of the bottom panel 14. As shown in FIG. 5 the interior panel 34 is joined, as by stitching, along each longitudinal side and one end thereof to the bottom panel 14. However, any three edges of the interior panel 34 may be selected for being secured to the bottom panel 14 so as to provide a pocket 36 of sufficient size to accommodate a backpacker's foam sleeping pad or air mattress as necessary.

Figure 6:
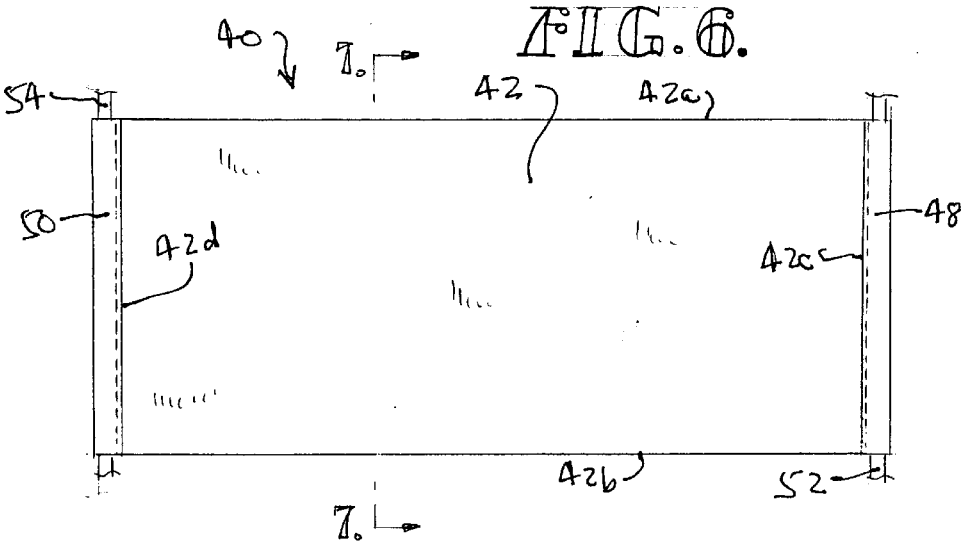
FIG. 6 is a top plan view of a hammock constructed in accordance with a second preferred embodiment of the invention shown prior to suspension between a pair of supports.
Figure 7:
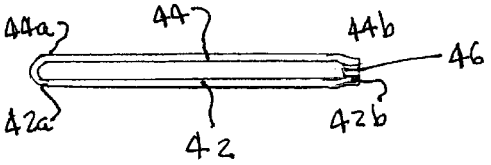
FIG. 7 is a sectional view of the hammock taken along line 7—7 of FIG. 6 in the directions of the arrows.

For the true minimalist in lightweight backpacking gear, an alternative embodiment of the invention is illustrated in FIGS. 6 & 7. The hammock, generally designated by the numeral 40, includes a generally rectangular, bottom panel 42 having a width and a length appropriately sized to accommodate the user. The bottom panel 42 has longitudinal side edges 42*a* & 42*b* which extend along the length of the panel and lateral end edges 42*c* & 42*d* which extend along the width of the panel.

The hammock 40 also includes a generally rectangular, top panel 44 which covers the bottom panel 42 and which has a width and a length substantially corresponding to those dimensions of the bottom panel 42. Accordingly, the top panel 44 has longitudinal side edges 44*a* & 44*b* which extend along the length of the top panel 44 and correspond respectively to the longitudinal side edges 42*a* & 42*b* of the bottom panel 42. Similarly, the top panel 44 has lateral end edges which extend along the width of the top panel 44 and correspond respectively to the lateral end edges 42*c* & 42*d* of the bottom panel 42.

More particularly, in the construction of the second embodiment of hammock 40, only the longitudinal side edge 42*a* of the bottom panel 42 is integrally formed with or securely connected to the corresponding longitudinal side edge 44*a* of the top panel 44. Similar to the construction of the first embodiment, however, the lateral end edges 42*c* & 42*d* of the bottom panel 42 are integrally formed with or securely connected to the corresponding lateral end edges of the top panel 44.

So constructed, therefore, the longitudinal side edge 42*b* of the bottom panel 42 and the corresponding, but unjoined, longitudinal side edge 44*b* of the top panel 44 form an elongate slit or opening 46 to provide access to the space defined by the top panel 44 and the bottom panel 42.

Secured at least to each end edges 42*c* & 42*d* of the bottom panel 42 are tubular sleeves 48 & 50 which extend substantially the width of the bottom panel 42. The tubular sleeves 48 & 50 may also be secured to the end edges of the top panel 44.

Received respectively within the tubular sleeves 48 & 50 are web or belt members 52 & 54 of which only a portion is shown in FIG. 6 because the construction is the same as previously described for the first embodiment. Likewise, it will be understood that each web 52 & 54 is fitted with a buckle fastener (not shown). Keeping with the desire to minimize weight, the alternative embodiment shown in FIGS. 6 & 7 does not include an interior panel to form a sleeping foam pocket.

In terms of materials of construction, the various panels and tubular sleeves of the hammock 10 or 40 may be fabricated from a tightly woven, flexible fabric. For example, ripstop nylon is strong and durable for this application. Various weight grades of fabric may be selected as appropriate for the tradeoff between the advantages of lightweight versus greater durability. Likewise, the fabric may be coated or waterproofed as desired assuming the added weight of such treatment is acceptable. The web members may be nylon belting material of at least ¾ inch width fitted with buckles preferably made of lightweight polymer material.

With the exception of the buckles themselves, the rest of the hammock construction is of relatively flexible material which may be readily folded, stuffed or otherwise packed in a small space within a backpack or stuff sack.

In operation, the user simply removes the hammock 10 from storage and selects appropriately spaced apart trees 11 & 12 from which to suspend the hammock. The web or belt 26 extending from each end of the tubular sleeve 22 is caused to encircle the tree 12 and the buckle fastener 30 is closed. If too much slack exists in the belt 26, then the tag end may be pulled to snug the belt around the tree. It is important that the webbing material pass directly from the end of the tubular sleeve 22 around the tree 12 without the ends of the belt 26 twisting or crossing on itself. This permits the fabric of the tubular sleeve 22 to bunch together on the web so as to span a distance at least about ten percent of the overall width of the hammock when the top and bottom panels 16 & 14 still have a rectangular form (i.e., before suspension from the tree). Thus the bunching of the tubular sleeve 22 on the web 26, the diameter of the tree 12 itself, and, most importantly, the resistance to torsion of the web 26 all combine to provide a stable hammock suspension.

In like manner, the opposite belt 28 in tubular sleeve 24 may be secured by buckle 32 around the opposite tree 11. The resultant hammock suspension is extremely resistant to the tipping and rolling motions heretofore associated with conventional hammocks. The installation can be quickly accomplished without special knowledge or skill in knot tying techniques, and without marring or otherwise damaging the tree from which the hammock is suspended.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS hammock 10
trees 11 & 12
bottom panel 14
  longitudinal side edges 14*a* & 14*b*
  lateral end edges 14*c* & 14*d*
top panel 16
  longitudinal side edges 16*a* & 16*b*
  lateral end edges 16*c* & 16*d*
slit or opening 18
fasteners 20
tubular sleeves 22 & 24
web or belt members 26 & 28
buckles 30 & 32
interior panel 34
interior pocket 36
hammock 40
bottom panel 42
  longitudinal side edges 42*a* & 42*b*
  lateral end edges 42*c* & 42*d*
top panel 44
  longitudinal side edges 44*a* & 44*b*
  lateral end edges
elongate slit or opening 46
tubular sleeves 48 & 50
web or belt members 52 & 54

Having thus described my invention, I claim:

1. A light weight, portable hammock for suspension between two supports, said hammock comprising:

a generally rectangular bottom panel having a width and a length sufficiently sized to support a reclined user, said bottom panel having longitudinal side edges and lateral end edges;

a generally rectangular top panel substantially overlying said bottom panel and having a width and a length substantially corresponding to the width and length of said bottom panel, said top panel having longitudinal side edges and lateral end edges corresponding respectively to said longitudinal side edges and lateral end edges of said bottom panel, said top panel joined to said bottom panel at least along three of said side and end edges;

an access opening sufficiently sized to admit a user between said top and bottom panels;

first and second elongate tubular sleeves secured at least to the end edges of said bottom panel; and first and second elongate web members having greater width than thickness, having a fastener coupled to each end, each of said fasteners adapted to be coupled to the fastener at the other end of said web member, and being received respectively within said first and second tubular sleeves and extending therefrom an effective length to be removably connected to said supports to suspendingly support said hammock therebetween, each of said tubular sleeves and said web members at least partially encircling one of said supports as said hammock is suspendingly supported.

2. The portable hammock as in claim 1, said top and bottom panels being fabricated of a tightly woven, flexible fabric.

3. The portable hammock as in claim 1, said tubular sleeves being fabricated of flexible material in order to bunch together on said web members over a distance less than the width of said bottom panel but greater than ten percent of the width of said bottom panel when said web members are connected to said supports in order to resist torsional movement of said hammock suspended from said supports.

4. The portable hammock as in claim 1 further including reinforcing and abrasion resistant sections attached to the ends of said tubular sleeves through which said web members extend.

5. The portable hammock as in claim 1, said web members being selectively adjustable to shorten the effective length thereof for tensioning said hammock between said supports.

6. The portable hammock as in claim 1, said access opening being oriented substantially parallel with said longitudinal sides of said top and bottom panels.

7. The portable hammock as in claim 6, said access opening being formed by one, substantially unjoined, longitudinal edge of said top and bottom panels.

8. The portable hammock as in claim 7, said top and bottom panels being secured along substantially all four edges thereof and said access opening being formed in said top panel between said longitudinal sides of said top panel.

9. The portable hammock as in claim 1 further including fasteners secured to said top panel adjacent said access opening and operable to selectively close said opening.

10. The portable hammock as in claim 1 further comprising a third panel having a width and length less than the corresponding width and length of said bottom panel, and being secured to said bottom panel to form an interior pocket therewith.

11. The portable hammock as in claim 10, said third panel having side and end edges and being joined to said bottom panel along at least three of said side and end edges of said third panel.

12. The portable hammock as in claim 11, said third panel being joined to said bottom panel along two side edges and one end edge of said third panel.

13. The portable hammock as in claim 10 further including a cushion pad received within said interior pocket.

* * * * *